US007454029B2

(12) United States Patent
Andrews

(10) Patent No.: US 7,454,029 B2
(45) Date of Patent: Nov. 18, 2008

(54) LOUDSPEAKER ARRAY

(76) Inventor: Anthony J. Andrews, Funktion One Reserach, Hoyle Farm, Dorking, Surrey (GB) RH5 4PS ( * ) Notice: Subject to any disclaimer, the term of this patent is extended or adjusted under 35 U.S.C. 154(b) by 781 days.

(21) Appl. No.: 10/788,893

(22) Filed: Feb. 27, 2004

(65) Prior Publication Data

US 2004/0218773 A1 Nov. 4, 2004

(30) Foreign Application Priority Data

Mar. 20, 2003 (GB) ..... 0306415.1

(51) Int. Cl.
*H04R 1/02* (2006.01)

(52) U.S. Cl. ..... 381/335; 381/336; 381/386

(58) Field of Classification Search ..... 381/160, 381/336, 337, 339, 350, 332, 335, 386; 181/187, 181/189, 191, 199
See application file for complete search history.

(56) References Cited

U.S. PATENT DOCUMENTS

| | | | | |
|---|---|---|---|---|
| 3,637,039 | A | 1/1972 | Raichel et al. | |
| 4,344,504 | A | 8/1982 | Howze | |
| 4,862,508 | A | 8/1989 | Lemon | |
| 5,750,943 | A | 5/1998 | Heinz et al. | |
| 6,112,847 | A * | 9/2000 | Lehman | 181/152 |
| 6,394,223 | B1 | 5/2002 | Lehman | |
| 6,712,177 | B2 * | 3/2004 | Ureda | 181/152 |
| 2004/0240697 | A1 * | 12/2004 | Keele, Jr. | 381/336 |

FOREIGN PATENT DOCUMENTS

| | | |
|---|---|---|
| FR | 2478417 | 9/1981 |
| GB | 2 075 809 | 3/1981 |
| GB | 2 284 125 | 7/1994 |

* cited by examiner

*Primary Examiner*—Vivian Chin
*Assistant Examiner*—George C Monikang
(74) *Attorney, Agent, or Firm*—Andrus, Sceales, Starke & Sawall, LLP

(57) ABSTRACT

A loudspeaker array comprising line sources, each of which comprises a curved one dimensional array of loudspeakers. The loudspeakers have horizontal dispersion angles of less than 60°. Adjacent pairs of loudspeakers of each line source are time-aligned in a direction bisecting their propagation axes, which are in a common vertical plane.

24 Claims, 12 Drawing Sheets

Figure 6
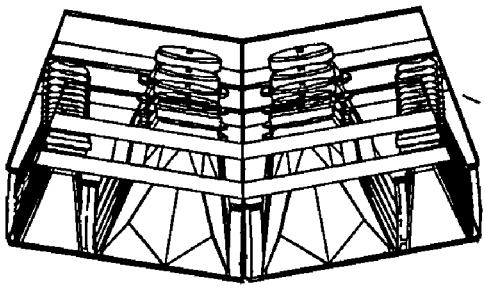
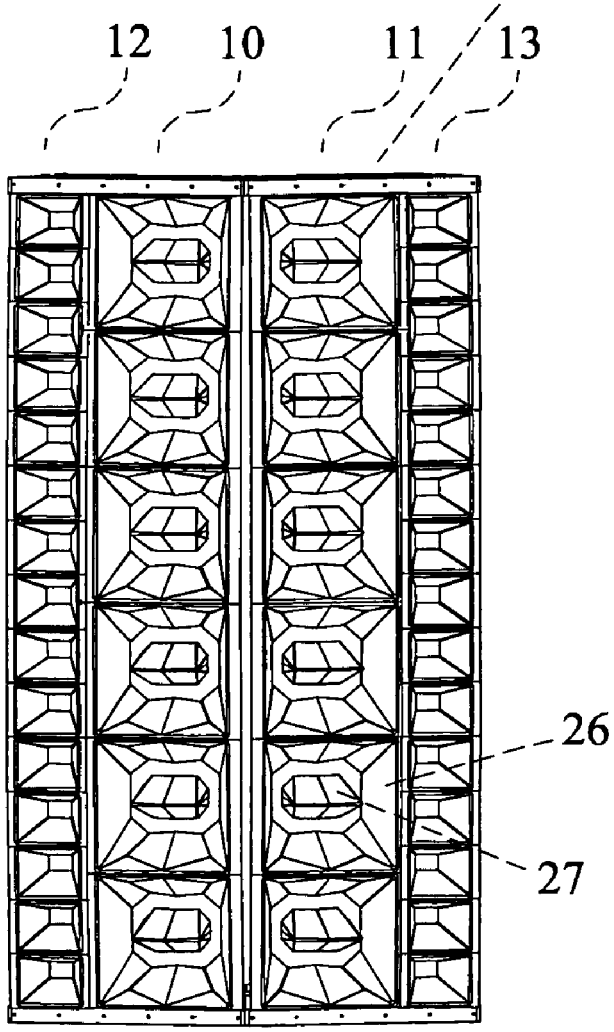
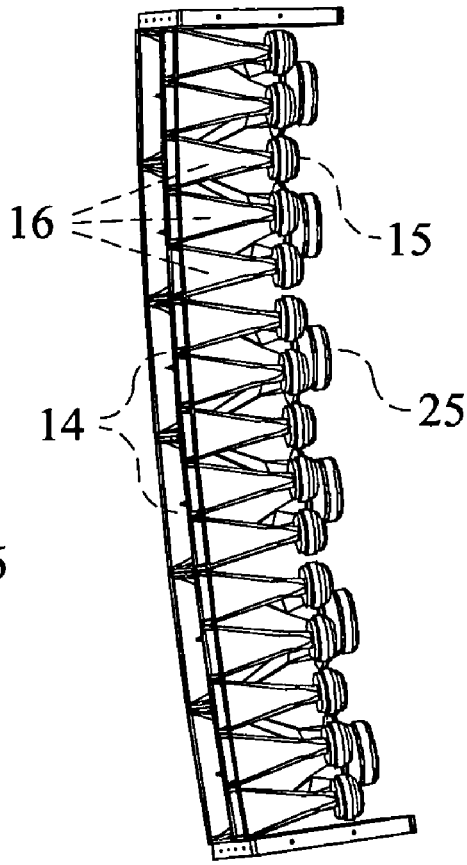
Figure 4
Figure 5

Figure 8
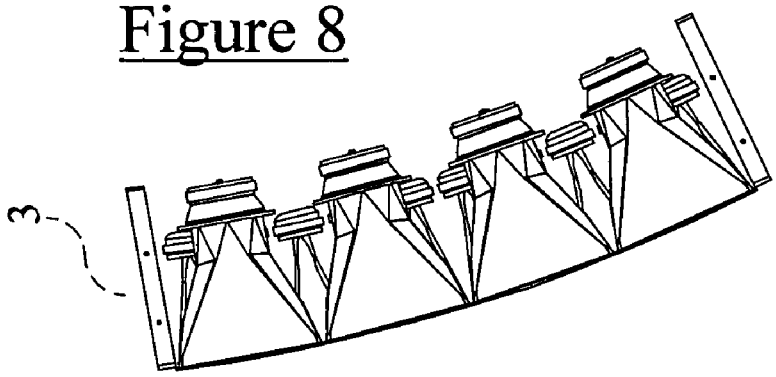
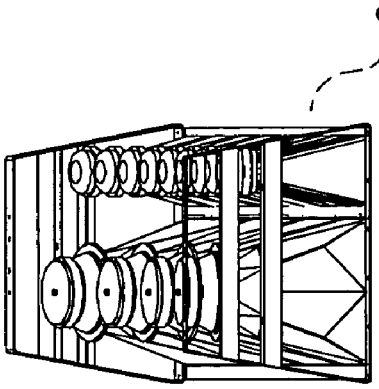
Figure 9
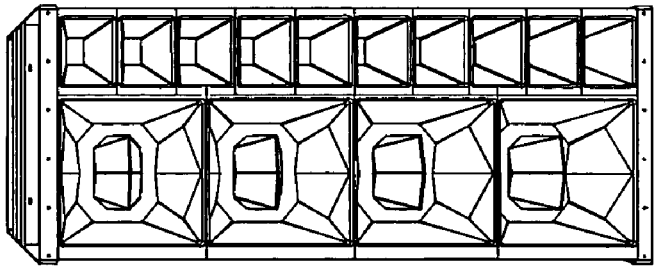
Figure 7
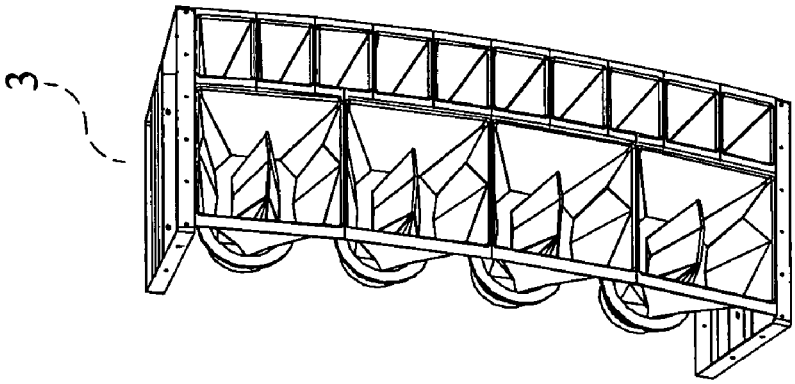
Figure 10

LOUDSPEAKER ARRAY

TECHNICAL FIELD

The present invention relates to a loudspeaker array and to a loudspeaker system comprising a plurality of such arrays. Such an array or system may be used in a sound reinforcement system or "PA" (public address) system to provide sound reinforcement in an enclosed or "open air" auditorium or arena of relatively large size.

BACKGROUND

A known type of sound reinforcement system makes use of "line sources" of loudspeakers. Each loudspeaker comprises an electro-acoustic driver housed in some form of enclosure with the diaphragm of the driver radiating from a front of the enclosure directly into the environment. The individual loudspeakers are arranged as vertical one-dimensional arrays. Such arrays radiate sound throughout a very large angle in a horizontal plane. A typical line source radiates sound averagely through an angle of 90° and up to 130° in a horizontal plane.

An advantage of such an arrangement is, theoretically, even coverage within a large included angle. However, a disadvantage is that, if more than one such line source is needed in order to provide sufficient sound pressure levels at a venue, several line sources must be used but must be spaced apart by a sufficiently large distance so as to avoid undesirable interference with each other. Mutual spacings of greater than about 30 feet (about 10 metres) are required so that undesirable interference effects are reduced to an acceptably low level, for example below normal audibility to listeners. Because of the wide dispersion pattern, it is impossible to avoid destructive interference when a listener is located away from a centre vertical plane between a pair of line sources. It is therefore impossible to achieve an increase in sound pressure level simply by adding another line source adjacent an existing line source.

The vertical dispersion of a line source of this type is very narrow. To achieve sufficient vertical dispersion, the angle in a vertical plane between the sound propagation axes of adjacent pairs of loudspeakers in the array is increased in small increments of increasing amount towards the bottom of the array. This results in a graduated curve of "J" shape so that people located nearly underneath the line source also receive sound.

The increase in vertical coverage provided by such a curved array is only achieved in and adjacent a vertical plane containing the propagation axes of the loudspeakers of the array. At locations away from this plane, the effective angle between adjacent pairs of sources is reduced. This continues until, for locations facing the side of the array at 90° to the vertical plane, the vertical angle between adjacent loudspeakers becomes 0°. In other words, because of the two-dimensional nature of the curve of the array, as a listener moves off axis (i.e. away from the vertical plane containing the propagation axes) in either horizontal direction, the vertical spreading of the beam produced by the line array steadily disappears with increasing angular distance from the vertical plane. Because of the wide dispersion angle in the horizontal or generally horizontal direction, substantial sound pressures are directed in angles well away from the propagation axis of each loudspeaker. The reducing curvature with increasing off-axis angle results in beaming of sound with a higher directivity and a different perceived frequency response compared with on-axis and near-axis listening positions.

In applications where the locations of the loudspeakers of a sound reinforcement system are limited, a system based on conventional line sources may be difficult, inconvenient, or impossible to provide. For example, in applications where sound reinforcement is required throughout a relatively large area but sound reinforcement loudspeakers are restricted in location to a much smaller area, conventional line source techniques are not capable of providing an acceptable sound pressure level throughout the area. An example of such a situation is in a rectangular arena, comprising audience accommodation around the sides of a sports area, where the sound reinforcement loudspeakers may only by located at the middle of a shorter side of the rectangular arena.

U.S. Pat. No. 4,862,508 discloses an array of loudspeakers covering different frequency ranges. For example, one embodiment comprises a low frequency loudspeaker with two drivers, a mid-range loudspeaker above the low frequency loud speaker, and a tweeter above the mid-range unit. Another embodiment comprises a tweeter with mid-range loudspeakers above and below it.

U.S. Pat. No. 3,637,039 discloses a domestic loudspeaker having a two-dimensional array of drive units on a baffle.

U.S. Pat. No. 4,344,504 discloses a straight line array of horn loudspeakers opening into a waveguide which is common to all of the loudspeakers.

SUMMARY

According to a first aspect of the invention, there is provided a loudspeaker array comprising at least one line source, the or each line source comprising a curved one-dimensional array of loudspeakers having propagation axes in a common plane which, in use, is substantially vertical, each adjacent pair of loudspeakers of the or each line source being physically time-aligned in a direction bisecting the propagation axes of the adjacent pair of loudspeakers, and each of the loudspeakers having a dispersion pattern angle of less than 60° in a plane which is perpendicular to the one-dimension at the loudspeaker.

At least one of the loudspeakers may have a dispersion pattern angle of less than 50° in the plane perpendicular to the one dimension. At least one of the loudspeakers may have a dispersion pattern angle of less than 40° in the plane perpendicular to the one dimension. At least one of the loudspeakers may have a dispersion pattern angle of less than 30° in the plane perpendicular to the one dimension. At least one of the loudspeakers may have a dispersion pattern angle of less than 20° in the plane perpendicular to the one dimension.

All of the loudspeakers of the or at least one line source may have the same dispersion pattern angle in the plane perpendicular to the one dimension.

As an alternative, an upper one of the loudspeakers of the or at least one line source may have a narrower dispersion pattern angle in the plane perpendicular to the one dimension than a lower one thereof.

All of the loudspeakers in the or at least one line source may have the same dispersion pattern angle in the plane containing the propagation axes.

Each of the loudspeakers may be horn-loaded. Each of the loudspeakers may comprise inner and outer horn-loading members defining therebetween a single sound propagation channel whose shape perpendicular to the propagation axis is topologically equivalent (isomorphic?) to an annulus.

Each of the loudspeakers may be arranged to produce a substantially plane wave throughout the frequency range of the loudspeaker.

The or each line source may comprise at least three loudspeakers.

The common plane may contain the one dimension. The propagation axes of adjacent pairs of loudspeakers in the or each line source may subtend an angle greater than 0° and less than or substantially equal to 12°.

The propagation axes of an upper pair of loudspeakers of the or at least one line source may subtend a smaller angle than the propagation axes of a lower pair thereof.

The curved one-dimensional array may be convex.

The loudspeakers of the or each line source may be disposed on an arc which is part of one of a circle, a catenary, a parabola and a hyperbola. The loudspeakers of the or each line source may be arranged to radiate away from a centre of curvature of the arc.

The loudspeakers of the or each line source may be of the same type.

The array may have a frequency range from substantially 200 Hz to substantially 8 KHz.

The array may comprise a plurality of line sources disposed laterally adjacent each other. The planes containing the sound propagation axes of the or each adjacent pair of line sources may subtend an angle substantially equal to half the sum of the dispersion angles, in the planes perpendicular to the one dimensions, of first and second loudspeakers in first and second ones, respectively, of the adjacent pair of the line sources. Adjacent pairs of the loudspeakers in different ones of the line sources may be physically time-aligned in a direction bisecting the propagation axes of the adjacent pairs of loudspeakers.

The loudspeakers of the line sources may be of the same type. As an alternative, the line sources may comprise first and second sets, the loudspeakers of the or each line source of the first set having a first frequency range and the loudspeakers of the or each line source of the second set having a second frequency range different from the first frequency range. The first frequency range may be substantially contiguous with or may overlap the second frequency range.

According to a second aspect of the invention, there is provided a loudspeaker system comprising a plurality of loudspeaker arrays, each according to the first aspect of the invention.

The curvature of the or each line source of a first of the loudspeaker arrays may be different from the curvature of the or each line source of a second of the loudspeaker arrays.

Each loudspeaker has a sound propagation axis which is generally the central axis of the three dimensional dispersion pattern and sometimes, but not always, corresponds to the direction of maximum sound output. For example, in the case of cone diaphragm drivers driven by a voice coil in a magnetic gap having an acoustic channel or "waveguide" arrangement extending forwardly of the cone diaphragm with at least vertical and horizontal planes of symmetry, the sound propagation axis is defined by the line at the intersection of the planes of symmetry.

In the case of a generally vertically extending line source, for off-axis listening in the horizontal plane, the sound pressure level generally falls as the angle relative to the sound propagation axis increases. The angle of a dispersion pattern is the angle between directions at which the sound pressure level has fallen to a predetermined level relative to a reference level. Typically, the sound pressure level on the sound propagation axis is taken as the reference level and the dispersion pattern angle is measured between the directions at which sound pressure level has dropped by three decibels (−3 dB) relative to the reference level. This corresponds to half the reference loudness in audible terms.

Physical time-alignment refers to the effective point source constituted by each loudspeaker. In the case of cone diaphragm loudspeakers driven at or near the centre of the cone by a voice coil former carrying a voice coil within a magnetic gap, the diaphragm does not move as a rigid unit because of its finite flexibility. The effective point source of such a driver is therefore in the region where the former is fixed to the diaphragm since this is effectively the first point from which sound will be radiated. For a one dimensional curved array, physical time-alignment is achieved by disposing the loudspeakers such that the sound propagation axes of each adjacent pair intersect each other at a point and the effective point sources of the pair are spaced by the same distance from this intersection point.

The or each line source is "one dimensional" in the conventional sense of having no width and depth, but is curved in a plane containing the propagation axes of the loudspeakers. In a typical arrangement, the effective point sources of the loudspeakers are arranged in a vertical plane with the one dimension and the sound propagation axes all being contained in that plane. The line source is arranged as a one dimensional curved line array and the curve may have the shape, for example, of a "J" or part of a circle, a catenary, a parabola or a hyperbola. In embodiments where there are two or more line sources, the effective sound sources may, for example, be disposed on a surface, for example a spherical surface, with the sound propagation axes being directed radially outwardly.

The angle between adjacent pairs of loudspeakers, and hence the degree of curvature of the one-dimensional array, depends on the coverage required of the loudspeaker array. For example, in order to provide wide coverage of a relatively less distant region, the angles between adjacent pairs of loudspeakers may be several degrees and even 10 degrees or more. Conversely, where relatively narrow coverage is required and/or coverage of a relatively distant location is required, the angles between adjacent loudspeakers may be relatively small. For example, angles of a few tenths of a degree, such as half a degree, may be appropriate for specific examples of such situations. The curvature of the curved array is thus chosen according to the vertical dispersion which is required in any particular application. In particular, the narrow beaming effect of straight line arrays is avoided by the use of a curved array and the vertical dispersion angle of the array can be chosen as appropriate by selecting the line array curvature.

The dispersion pattern perpendicular to the one dimension is such as to permit line sources to be located close together without undesirable mutual interference. Thus, an array may be provided for covering a relatively large area from one relatively small region, for example at the edge of the area to be covered. By clustering loudspeaker arrays together, the sound dispersion provided by a system can be designed or arranged to provide a desired sound pressure level at substantially any point within a region to be covered.

Because of the relatively narrow lateral dispersion of the loudspeakers, the problems of known curved line sources described hereinbefore are substantially reduced. In particular, because the sound pressure level declines rapidly outside the angular dispersion range, the sideways beaming effect of known curved line sources is avoided or any residual sound energy at relatively large angles is of sufficiently low level so as not to cause the problems associated with the known arrangements. For example, an advantage of embodiments having narrow dispersion, horn loaded curvilinear line sources is that a substantially ideal dispersion pattern can be generated in increments of 20 degrees horizontally akin to adding narrow slices of a pie together, thus avoiding coverage and reflection issues associated with a fixed wide dispersion device. Thus, a very compact loudspeaker system can be provided for achieving a desired sound pressure level at any point in "line-of-sight" within an arena or other venue.

BRIEF DESCRIPTION OF THE DRAWINGS

FIG. 4 is a front partly diagrammatic view of a first loudspeaker array forming part of the system of FIG. 1;

FIG. 5 is a side view of the array of FIG. 4;

FIG. 6 is a plan view of the array of FIG. 4;

FIG. 7 is a front view of another array forming part of the system of FIG. 1;

FIG. 8 is a side view of the array of FIG. 7;

FIG. 9 is a plan view of the array of FIG. 7;

FIG. 10 is a view from the front and to the side of the array of FIG. 7;

Like reference numerals refer to like parts throughout the drawings.

DETAILED DESCRIPTION

Figure 1:
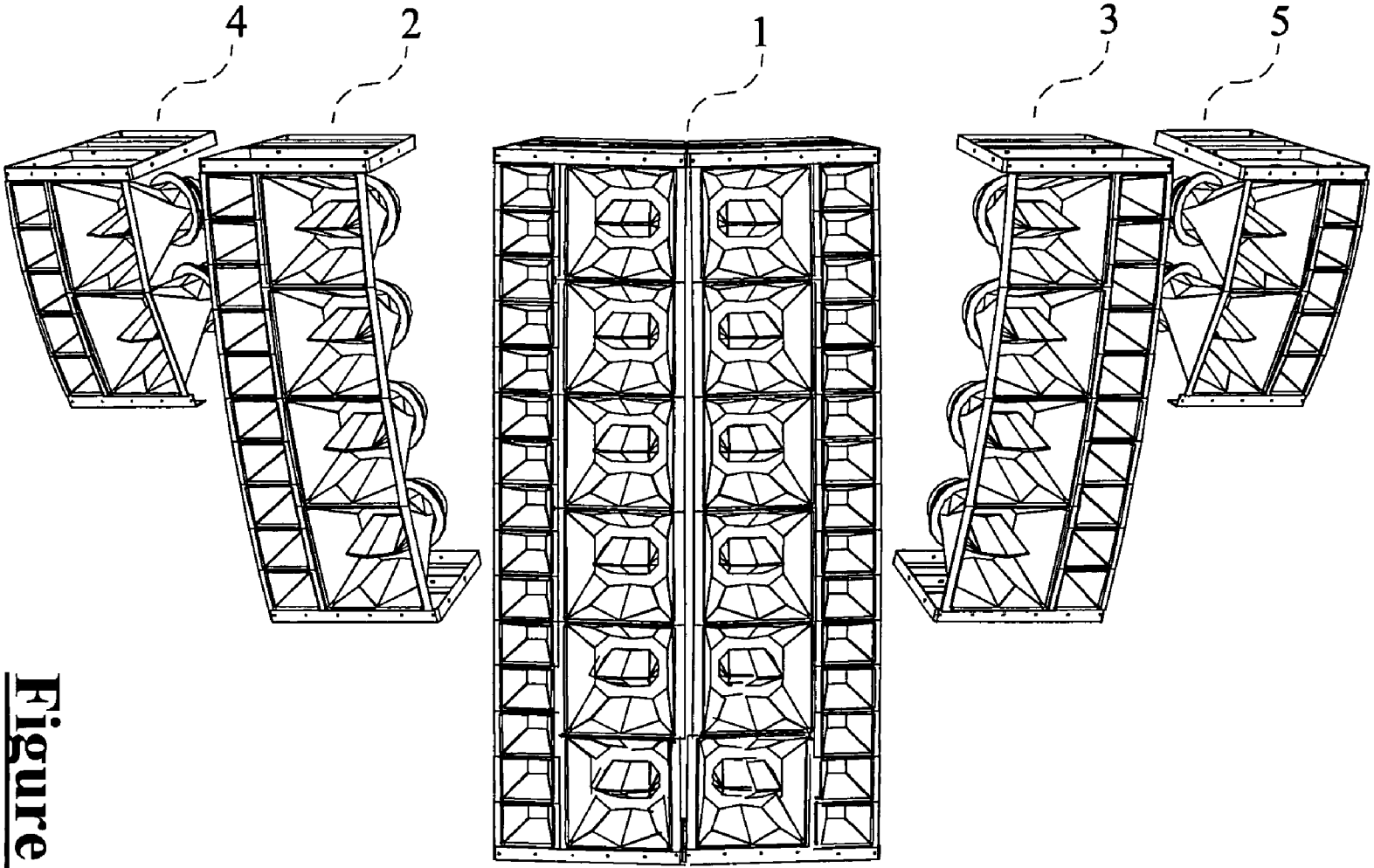
FIG. 1 is a front view of a loudspeaker system constituting an embodiment of the invention.
Figure 2:
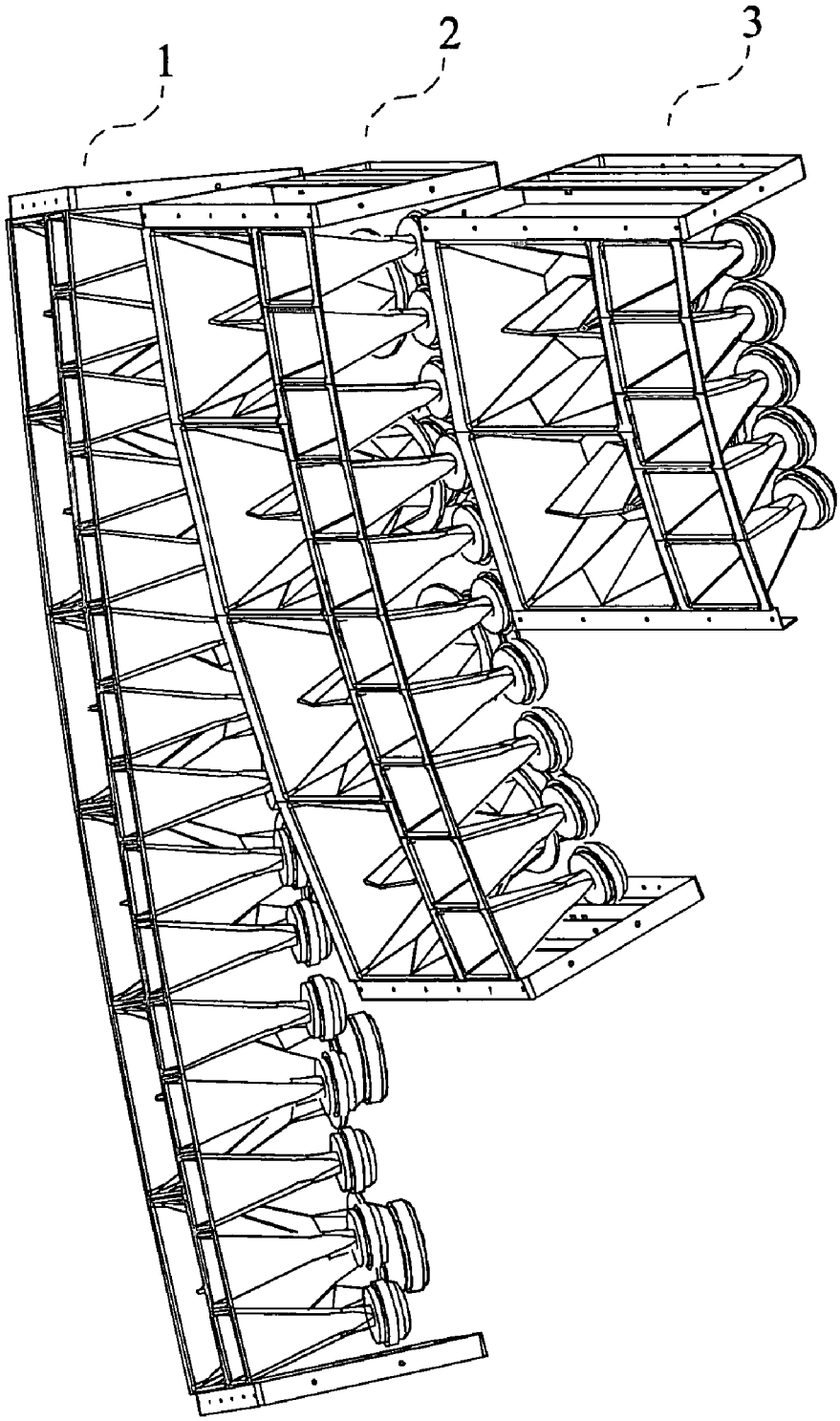
FIG. 2 is a side view of the system of FIG. 1.
Figure 3:
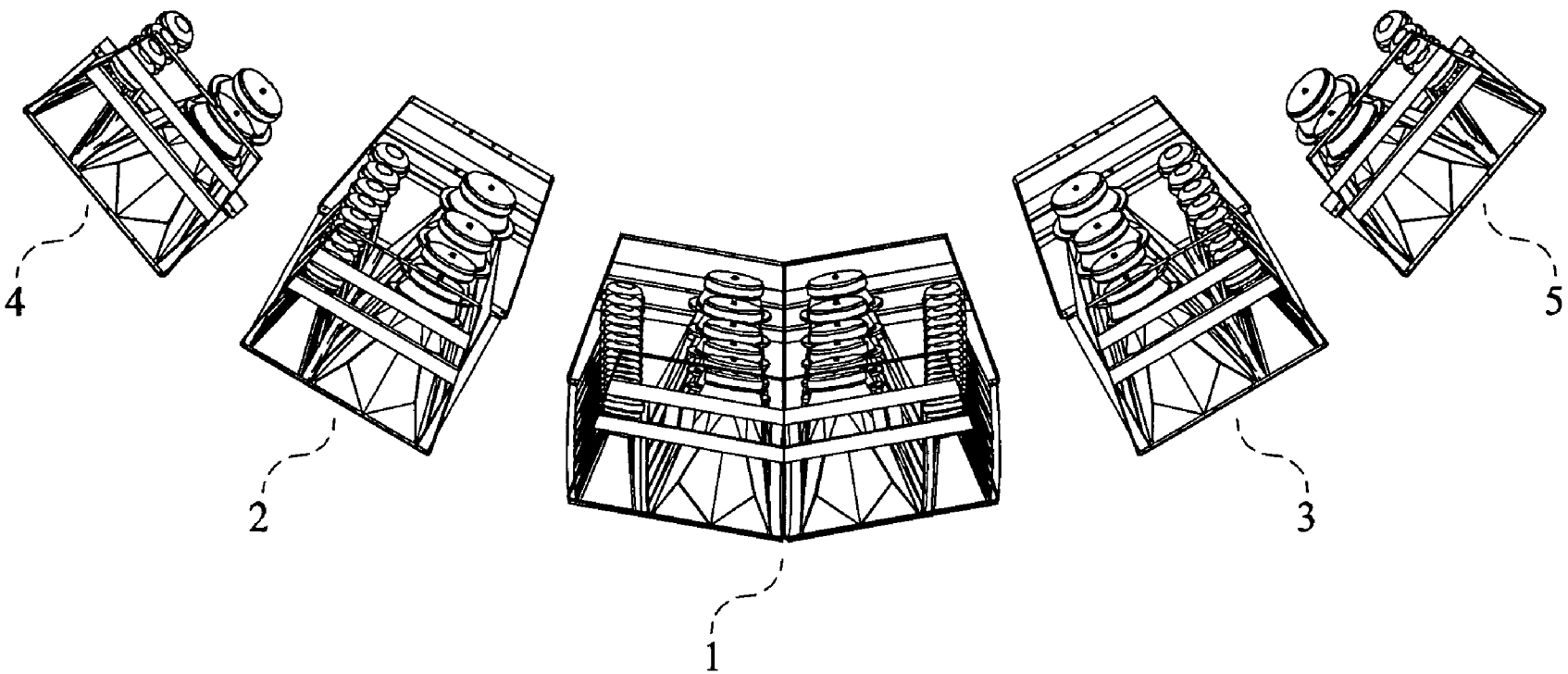
FIG. 3 is a plan view of the system of FIG. 1.

The loudspeaker system shown in FIGS. 1 to 3 comprises six loudspeaker arrays which are symmetrical about a central vertical plane and which cover a frequency range from about 250 Hz to about 17 KHz. Each of the arrays comprises mid range loudspeakers covering the frequency range from about 250 Hz to about 7 KHz and high frequency loudspeakers covering the frequency range from about 5.7 KHz to about 17 KHz. The loudspeaker system is intended, for example, for use in an arena of generally rectangular shape with a rectangular sports area and audience accommodation along two long sides and one short side of the rectangle. The system is intended for mounting generally at the middle of the other short side above audience level. The loudspeaker system occupies a very small region compared with the size of the arena and provides a desired and a sufficiently uniform sound pressure level throughout the whole of the audience accommodation.

The loudspeaker system comprises a pair of first loudspeaker arrays 1 for directing sound to an opposite short side of the arena, a pair of symmetrically arranged second arrays 2 and 3 for providing coverage of much of the long sides, and a symmetrical pair of third arrays 4 and 5 for providing cover of the nearer ends of the long sides.

The loudspeaker arrays 1 are shown in FIGS. 4 to 6 and comprise two pairs of line sources in the form of one-dimensional arrays of loudspeakers. The first pair comprises line sources 10 and 11 of mid-range loudspeakers whereas the second pair comprises line sources 12 and 13 of high frequency loudspeakers ("tweeters").

Each of the mid-range loudspeakers comprises an electromagnetic 8 inch (20 cm) diameter cone diaphragm driver such as 25 disposed at the rear of and directing sound into a "waveguide" for controlling, among other things, the sound dispersion pattern of the loudspeaker. In the example illustrated, the horizontal dispersion angle is about 20 degrees and the vertical dispersion angle is relatively small, for example less than 10 degrees. Each of the loudspeakers such as 14 produces a substantially plane wave and the dispersion patterns are such that the sound pressure level declines rapidly for angles greater than half the dispersion angle away from the sound propagation axis of the loudspeaker. The driver and the waveguide are both symmetrical about vertical and substantially horizontal planes and the intersection of these planes defines the sound propagation axis, about which the dispersion patterns vertically and horizontally are substantially symmetrical, as described in more detail hereinafter.

Each of the loudspeakers of the line sources 12 and 13 comprises a one inch (2.5 cm) diameter high frequency compression driver such as 15 directing sound into a horn such as 16. The drivers 15 and the horns 16 are also symmetrical about vertical and substantially horizontal planes, whose intersections define the sound propagation axes of the high frequency loudspeakers.

Each of the loudspeakers 14 may be of the type disclosed in U.S. patent application Ser. No. 08/199,455. Each of the drivers such as 25 is horn-loaded or "waveguided" by inner and outer members such as 26 and 27.

In the example illustrated in FIGS. 1 to 6, the loudspeakers of the arrays 1 are arranged such that their effective point sources are located on a convex surface with the sound propagation axes being directed radially outwardly. The line sources 10 and 11 are angled apart such that the vertical planes passing through the sound propagation axes of these line sources intersect at about 20 degrees. For many applications, it is appropriate for the angle in the horizontal plane between line sources to be substantially equal to the sound dispersion angle of the loudspeakers making up the sources. Such arrays thus produce substantially coherent wave fronts with well-defined and controllable directionality.

The effective point sources in the illustrated embodiment are disposed on the surface of any of a plurality of shapes or ranges of shapes according to the application. Such surfaces include the surface of a sphere, the surface of an ellipsoid and a surface having a first radius of curvature in the vertical plane and a second radius of curvature in the horizontal plane (such as a torus). Also, each of the line sources 10 to 12 is curved in the vertical plane by providing an angle greater than zero degrees and generally less than about 12 degrees in the vertical plane between the sound propagation axes of adjacent pairs of loudspeakers. The curvature may be varied, for example to resemble a "J" in side view, and may be made infinite for part of the array to provide a partially straight line array depending on the specific requirement, such as the distance to the region to be covered by the line source and the size of that region.

Disposing line sources of this type near to each other allows a system to be built and tuned to provide any desired pattern of sound pressure level within line-of-sight of the system. Interference between line sources is reduced or eliminated or acts constructively to allow line sources to be disposed adjacent each other.

FIGS. 7 to 9 illustrate the loudspeaker array 3 of FIG. 1 from four different views. The array 2 is the mirror image of the array 3.

The array 3 differs from the arrays 11 and 13 in that the mid-range array comprises four loudspeakers instead of six loudspeakers, the high range array comprises ten loudspeakers instead of fifteen, and the radius of curvature of the array 3 in the vertical plane is smaller so as to give a larger vertical dispersion angle for the array. The radius of curvature of the array 3 and its azimuth relative to the arrays 1 are determined by the "footprint" which the array 3 is required to cover and the number of loudspeakers is determined by distance to the footprint so as to provide a sufficiently uniform sound level at the audience area from all parts of the loudspeaker system.

The line sources 4 and 5 differ from the line sources 2 and 3 in that each mid-range array comprises two loudspeakers and each high frequency array comprises five loudspeakers. Again, the radius of curvature in the vertical plane and the azimuth are determined according to the required footprint, which is relatively near to the loudspeaker system so that fewer loudspeakers are required to provide the desired sound pressure level.

Figure 11:
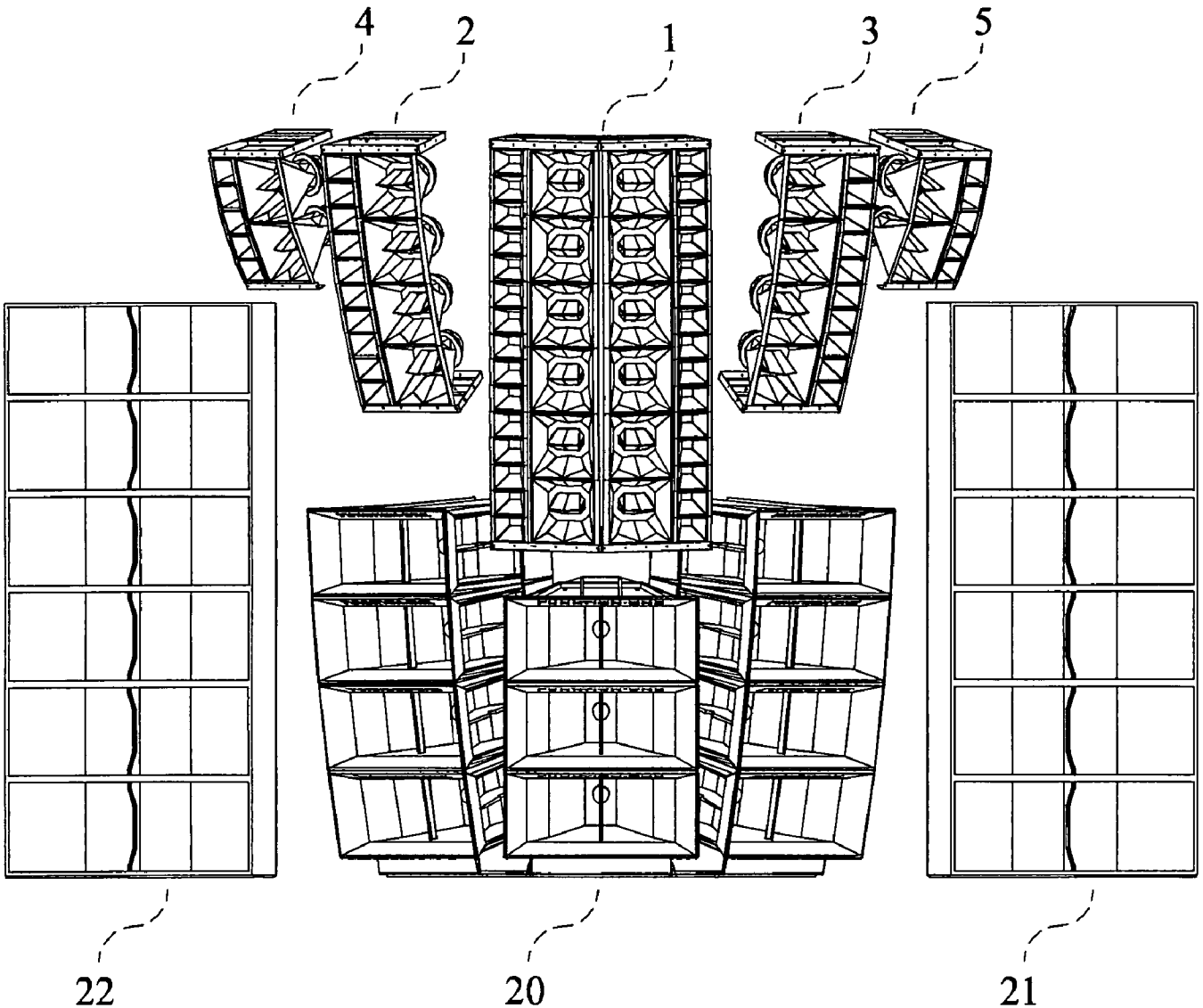
FIG. 11 is a front view of a full-range loudspeaker system including the system of FIG. 1.
Figure 12:
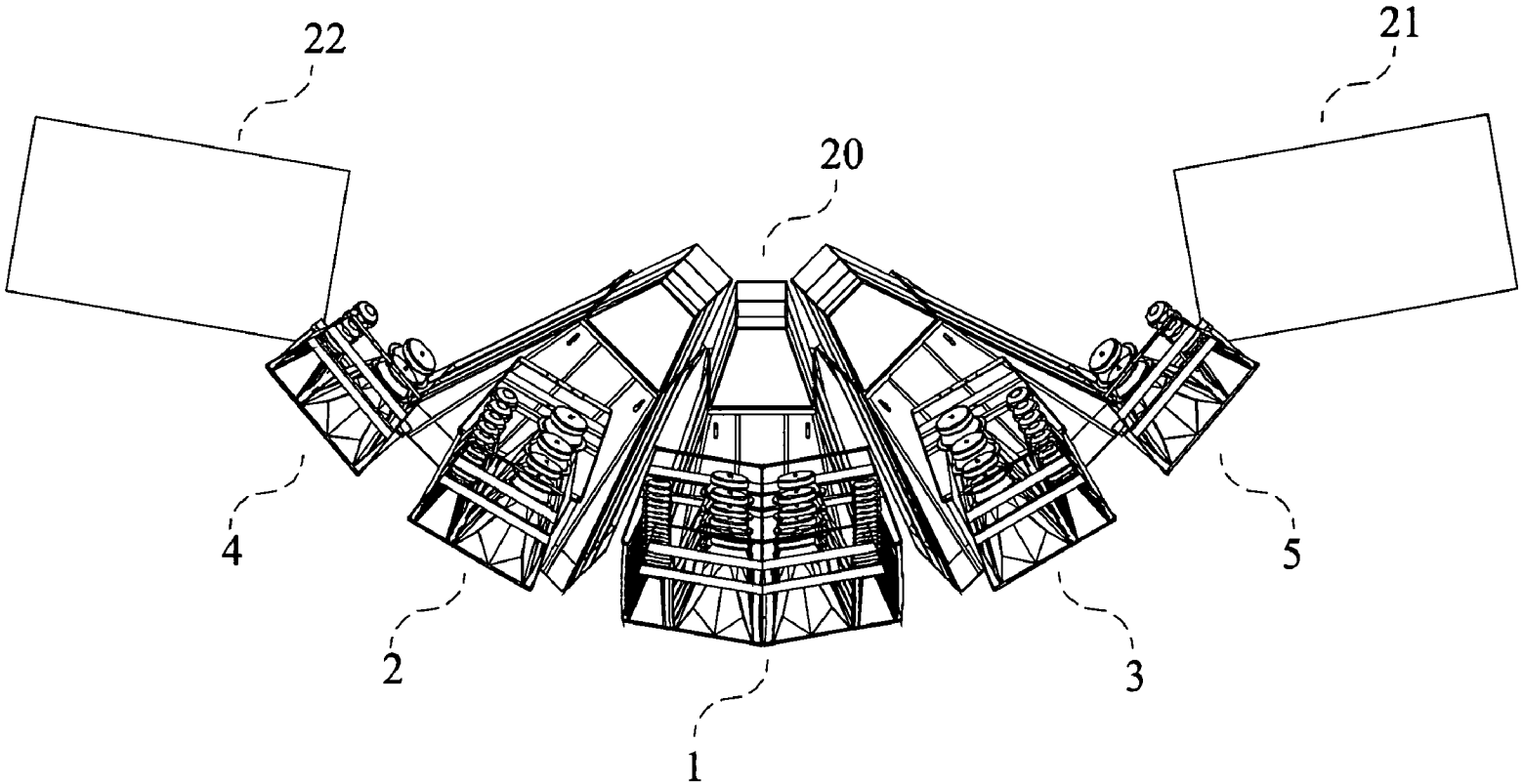
FIG. 12 is a plan view of the full-range system of FIG. 11.
Figure 13:
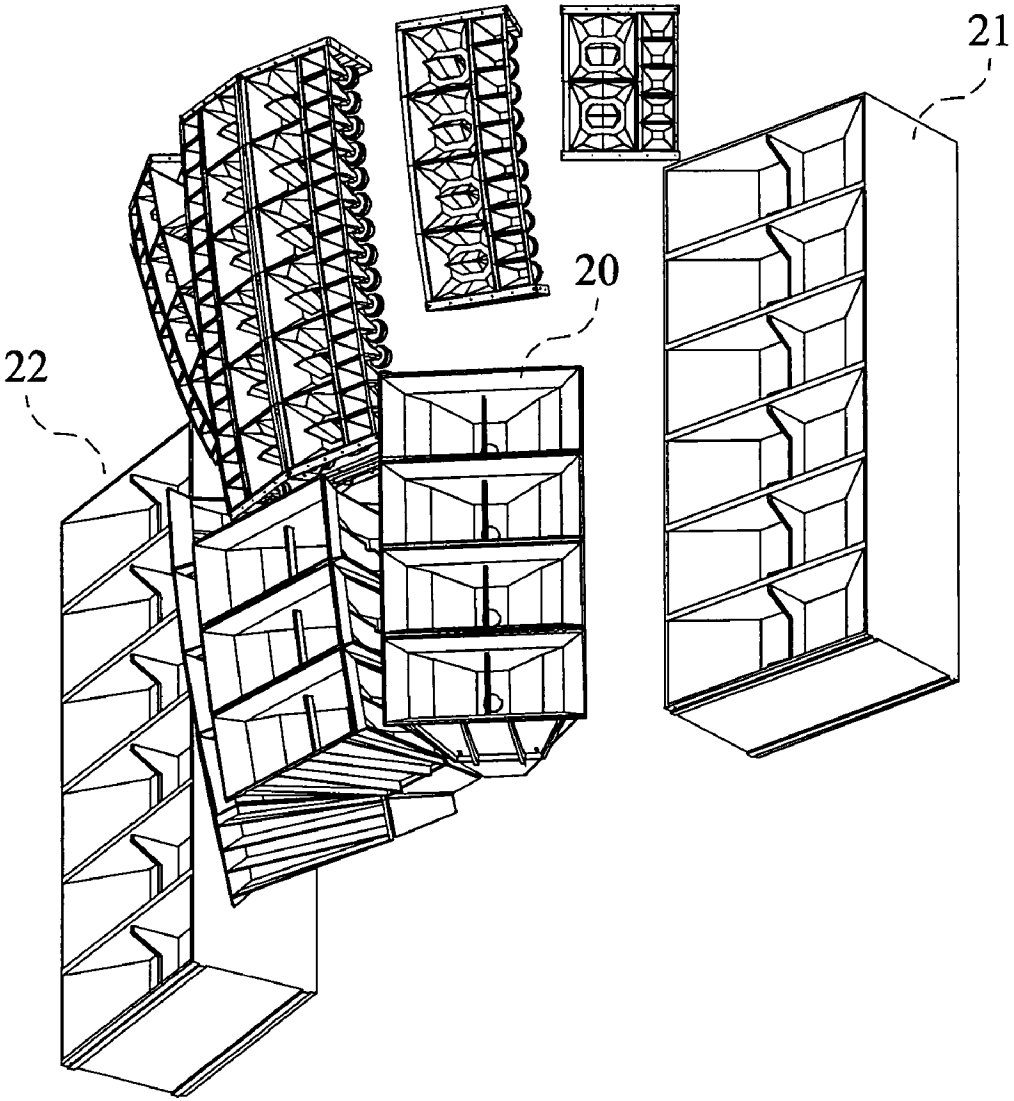
FIG. 13 is a view from the front of, to the side of and below the full-range system of FIG. 11.

The arrays 1 to 5 cover the audible frequency range above about 250 Hz. In order to provide a full-range system with a frequency range extending down to bass frequencies, these arrays may be augmented by further loudspeakers as illustrated in FIGS. 11 to 13. The lower-mid frequency range is handled by three curved line arrays of loudspeakers as illustrated at 20 whereas the low bass frequency range is handled by stacks of bass loudspeakers 21 and 22. Each of the loudspeakers 20 may be of the type disclosed, for example, in EP 1069803 and each of the bass loudspeakers may be of the type disclosed in EP 1164814. Although the dispersion patterns of the loudspeakers of the line arrays 20 are such that the same principles may be used in these line sources as in the line sources 1 to 5, the bass loudspeakers provide wider dispersion patterns so that the stacks 21 and 22 operate more like conventional line sources but with restricted frequency ranges.

Figure 14:
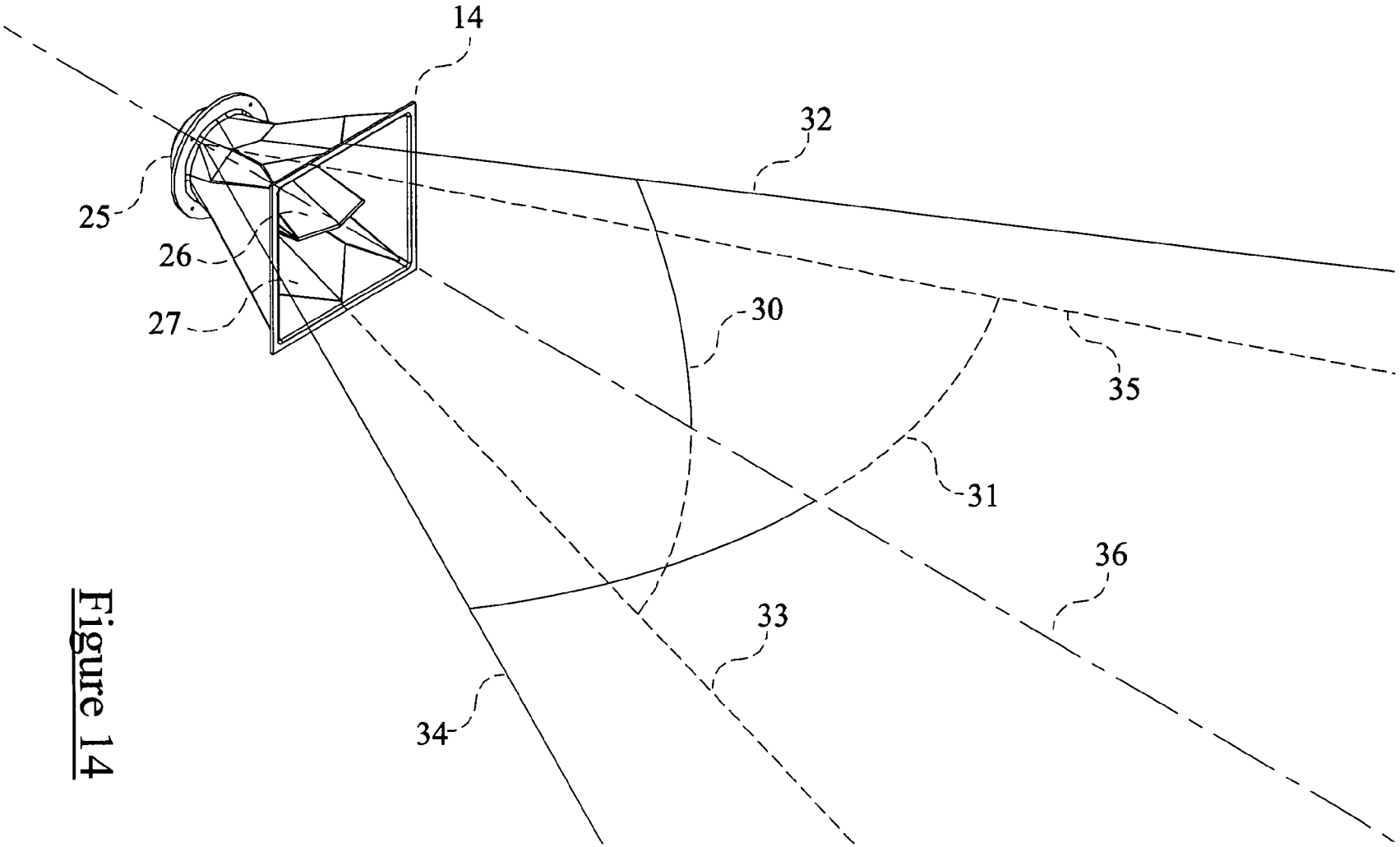
FIG. 14 is a drawing of a loudspeaker of the system of FIG. 1 illustrating a propagation axis and dispersion pattern angles.

FIG. 14 illustrates one of the loudspeakers 14 of the arrays 1 to 5. As described hereinbefore, the loudspeaker 14 comprises a driver 25 which is horn-loaded by members 26 and 27. In particular, the members 26 and 27 also control the "vertical" and "horizontal" dispersion patterns of the loudspeaker 14 to provide a substantially symmetrical vertical dispersion with a dispersion pattern angle 30, for example of 10°, and a substantially symmetrical horizontal dispersion pattern angle 31, for example of 20°. The loudspeaker 14 and the horizontal dispersion pattern are substantially symmetrical about a plane containing lines 32 and 33. Similarly, the vertical dispersion pattern and the loudspeaker 14 are substantially symmetrical about a horizontal plane containing lines 34 and 35. The planes of symmetry intersect at a line 36, which is the propagation axis of the loudspeaker 14.

Figure 15:
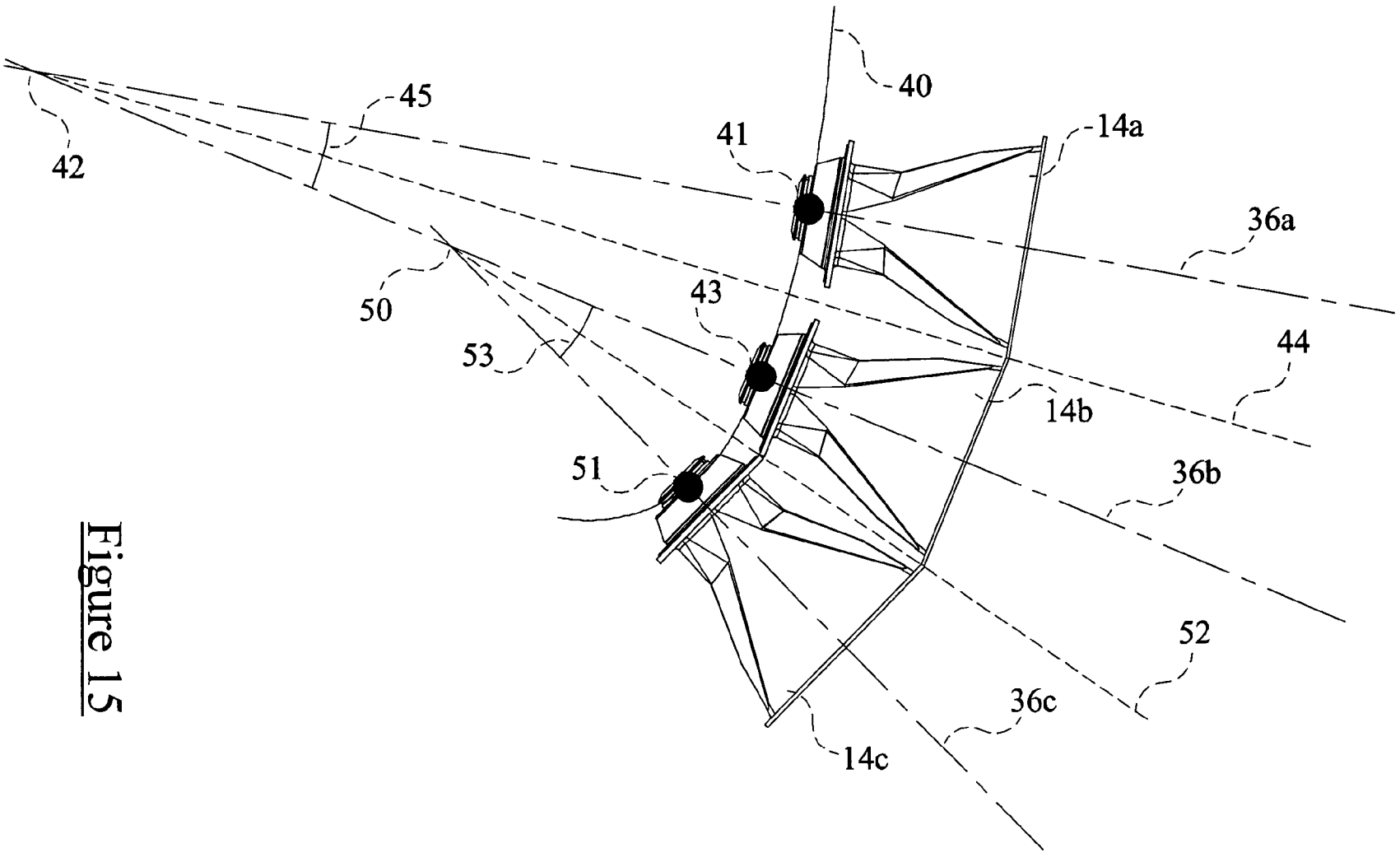
FIGS. 15 and 16 are diagrammatic side views of arrays constituting embodiments of the invention illustrating physical time-alignment.

FIG. 15 illustrates an example of part of a line source of generally "J" shape in side view. The line source is a one-dimensional array with the one-dimension being illustrated by the broken line 40, which passes through the effective point sources such as 41 of the loudspeakers 14*a* to 14*c*.

The upper loudspeakers 14*a* and 14*b* are physically time-aligned with each other. In particular, the loudspeakers 14*a* and 14*b* have propagation axes 36*a* and 36*b*, respectively, which intersect at a point 42. The distances from the point of intersection 42 to the effective point sources 41 and 43 of the loudspeakers 14*a* and 14*b* are substantially equal to each other. Thus, the loudspeakers 14*a* and 14*b* may be said to be time-aligned on a line 44 bisecting the angle 45 between the propagation axes 36*a* and 36*b*.

Similarly, the loudspeakers 14*b* and 14*c* have propagation axes 36*b* and 36*c*, which intersect at a point 50. The loudspeakers 14*b* and 14*c* are physically time-aligned with each other so that the distances from the point of intersection 50 to the effective point sources 43 and 51 of the loudspeakers 14*b* and 14*c* are substantially equal to each other. Again, the loudspeakers 14*b* and 14*c* may be said to be time-aligned on a line 52 bisecting the angle 53 between the propagation axes 36*b* and 36*c*.

The angle 53 is greater than the angle 45 because the radius of curvature of the one dimension 40 decreases with location down the one dimension 40. Thus, the angles between loudspeakers at the upper part of the array are relatively small and, for the top part of the array, one or more pairs of loudspeakers may be arranged with the propagation axes parallel to each other. The upper loudspeakers project sound to more remote parts of a venue and the beaming effect may be used to ensure sufficient sound pressure level is provided to the more remote locations. Conversely, the lower part of the array directs sound to closer parts of the venue so that a similar sound pressure level at such locations can be achieved without requiring as much or any interaction between adjacent loudspeakers.

Although the dispersion pattern angles perpendicular to the plane of FIG. 15 may be the same for all of the loudspeakers of the array, this is not necessary for all applications. For example, the lowermost loudspeaker 14*c* illustrated in FIG. 15 may have a wider dispersion pattern angle so as to provide a similar sound pressure level nearer the array to that provided at more distant locations.

Figure 16:
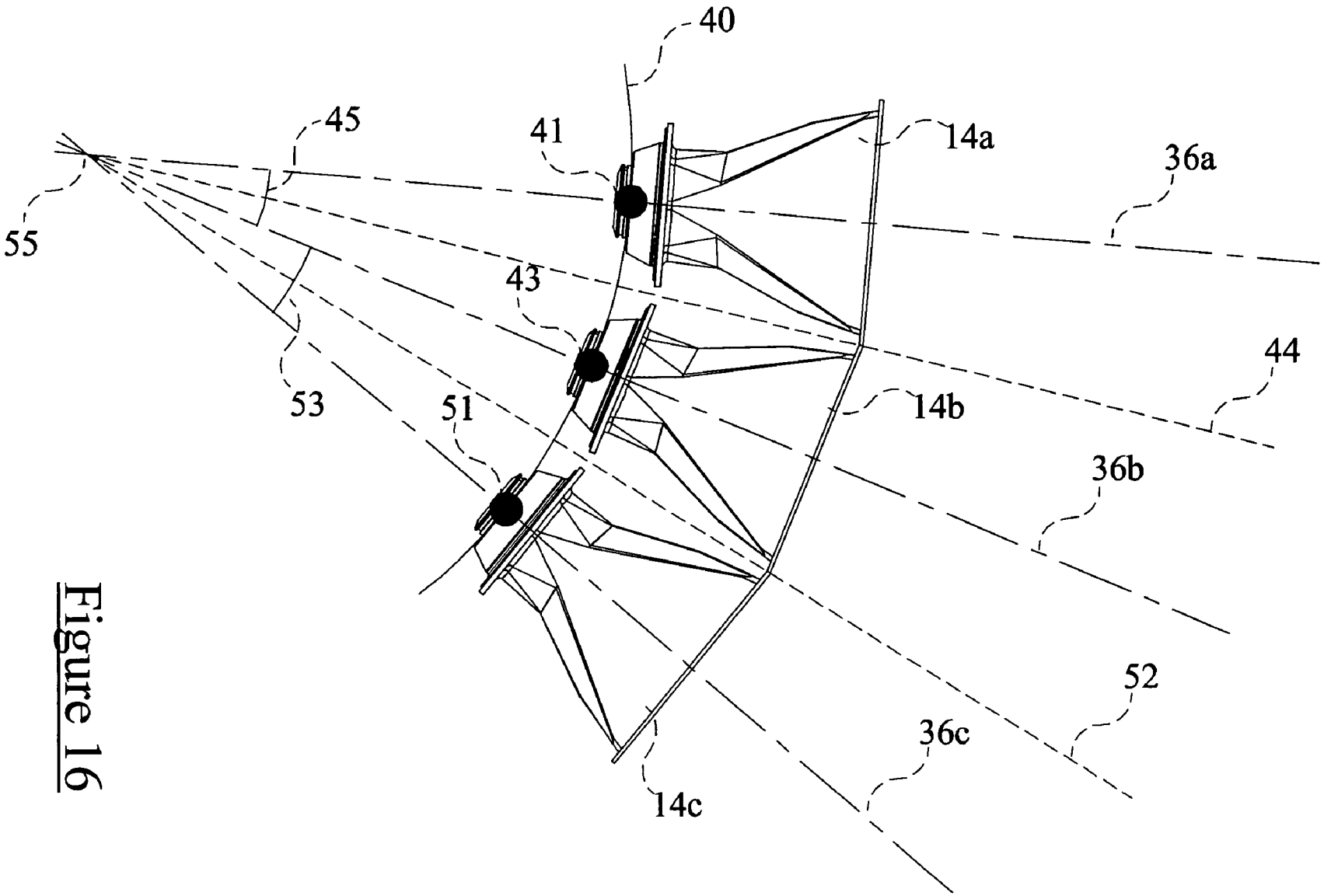

FIG. 16 illustrates an array which differs from that shown in FIG. 15 in that the loudspeakers 14*a* to 14*c* are disposed with their effective point sources 41, 43, 51 on a circular arc constituting the one-dimension 40. The propagation axes 36*a* to 36*c* all intersect at a common point 55 and the loudspeakers are oriented with the same angles 45 and 53 in the vertical plane containing the one-dimension 40 and the propagation axes 36*a* to 36*c*. The one-dimension 40 has a substantially constant radius of curvature.

Figure 17:
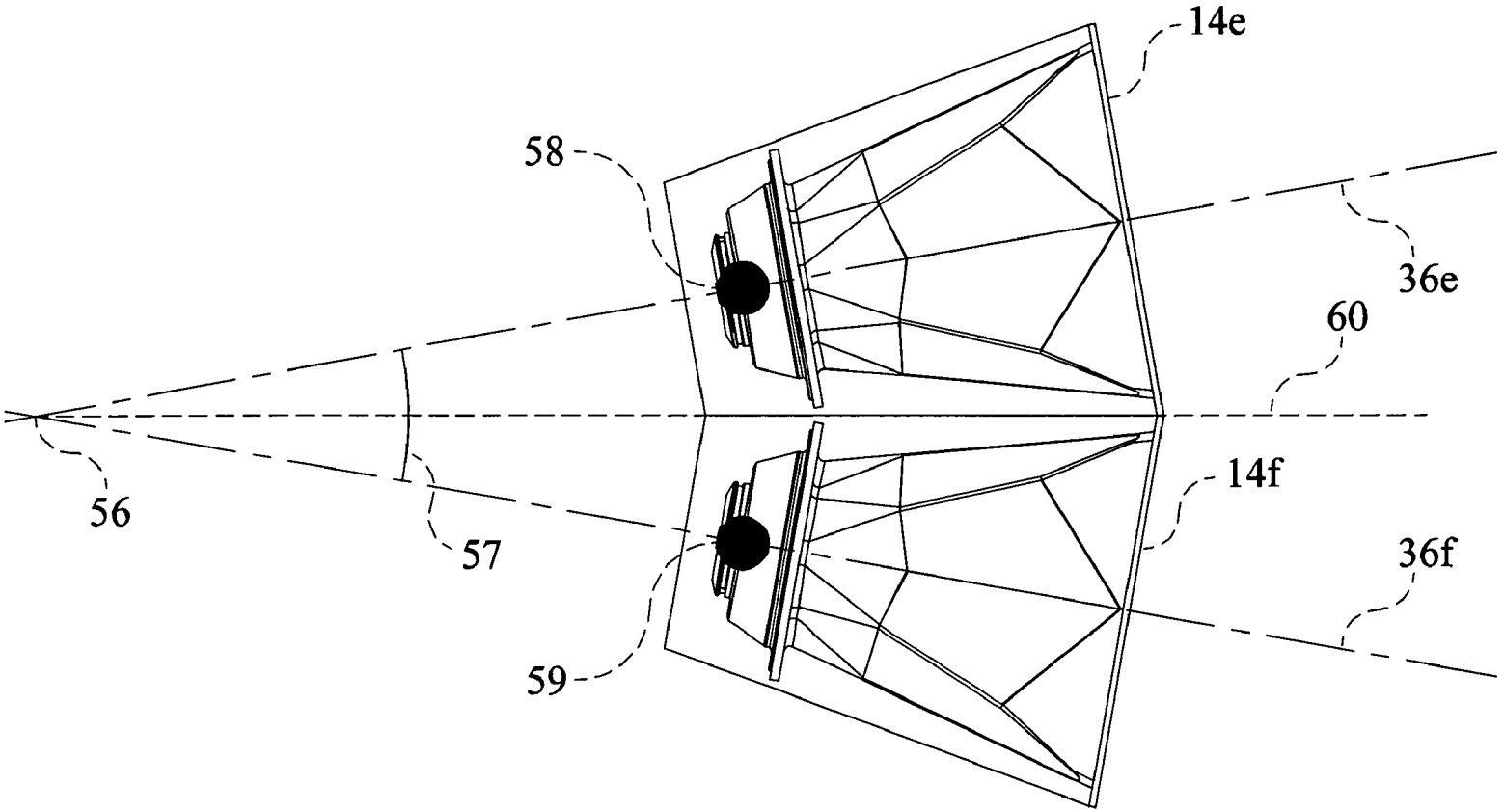
FIG. 17 is a cross-sectional diagram of loudspeakers in adjacent line arrays constituting an embodiment of the invention.

As described hereinbefore, the line sources may be arranged next to each other, for example as shown at 1 in FIG. 1. FIG. 17 illustrates the orientation of loudspeakers 14*e* and 14*f* which are adjacent each other in adjacent line sources. The propagation axes 36*e* and 36*f* intersect at a point 56. In fact, the planes containing the propagation axes of the line sources intersect at a line passing through the point 56 with an angle 57 between these planes. In many application, this line of intersection may be vertical or inclined at a small angle (for example less than 45°) to the vertical, but other applications may require different orientations of this line. For each adjacent pair of loudspeakers 14*e* and 14*f* in the line sources, the distances from the point of intersection 56 to the effective point sources 58 and 59 are substantially equal so as to provide physical time-alignment. The loudspeakers 14*e* and 14*f* may thus be said to be time-aligned on a line 60 bisecting the angle 57 between the propagation axes 36*e* and 36*f*.

The loudspeaker 14*e* and 14*f* may be designed to have any "horizontal" dispersion pattern angle within a range of values (by appropriately designing the members or "waveguides" 26 and 27) to allow the angle 57 to be chosen in accordance with requirements for a specific application of the system. The angle 57 is chosen such that there is relatively little interaction between the adjacent line arrays. This may be achieved, for example, by making the angle 57 equal to half the sum of the "horizontal" dispersion angles of the loudspeakers 14*e* and 14*f*.

As mentioned hereinbefore, although the horizontal and vertical dispersion pattern angles of all of the loudspeakers of an array may be the same, this is not necessary and both angles may vary depending on the nature of the specific application. For example, loudspeakers directed to closer parts of a venue may provide wider dispersion so that the same effective acoustic output is spread over a wider footprint to achieve improved matching of sound pressure levels at all distances within the "service area" of the system.

What is claimed is:

1. A mid-range loudspeaker array having a frequency range from substantially 250 Hz to substantially 8 KHZ, said loudspeaker array comprising at least one line source, said at least one line source comprising a curved one dimensional array of loudspeakers, each of which comprise a cone diaphragm driver and has a dispersion pattern angle of less than 60° in a plane which is perpendicular to a one dimension of said one dimensional array at said loudspeaker, said loudspeakers having propagation axes in a common plane which, in use, is vertical, each adjacent pair of said loudspeakers of each said line source being physically time-aligned in a direction bisecting said propagation axes of said loudspeakers of said adjacent pair, said propagation axes of said loudspeakers of said adjacent pairs in at least part of each said line source subtending an angle greater than 0°, said propagation axes of said loudspeakers of each said adjacent pair in each said line source subtending an angle of less than or substantially equal to 10°.

2. An array as claimed in claim 1, in which said dispersion pattern angle of at least one of said loudspeakers is less than 50° in said plane perpendicular to said one dimension.

3. An array as claimed in claim 1, in which said dispersion pattern angle of at least one of said loudspeakers is less than 40° in said plane perpendicular to said one dimension.

4. An array as claimed in claim 1, in which said dispersion pattern angle of at least one of said loudspeakers is less than 30° in said plane perpendicular to said one dimension.

5. An array as claimed in claim 1, in which said dispersion pattern angle of at least one of said loudspeakers is less than 20° in said plane perpendicular to said one dimension.

6. An array as claimed in claim 1, in which said dispersion pattern angles of all of said loudspeakers of said at least one line source have the same value in said plane perpendicular to said one dimension.

7. An array as claimed in claim 1, in which said dispersion pattern angle of an upper one of said loudspeakers of said at least one line source is less than said dispersion pattern angle of a lower one of said loudspeakers.

8. An array as claimed in claim 1, in which all of said loudspeakers of said at least one line source have a same dispersion pattern angle in said common plane.

9. An array as claimed in claim 1, in which each of said loudspeakers is horn-loaded.

10. An array as claimed in claim 9, in which each of said loudspeakers comprises inner and outer horn-loading members defining therebetween a single sound propagation channel whose shape perpendicular to said propagation axes is topologically equivalent to an annulus.

11. An array as claimed in claim 1, in which each of said loudspeakers is arranged to produce a substantially plane wave throughout a frequency range of said loudspeaker.

12. An array as claimed in claim 1, in which said at least one line source comprises at least three said loudspeakers.

13. An array as claimed in claim 1, in which said common plane contains said one dimension.

14. An array as claimed in claim 1, in which said propagation axes of adjacent pairs of said loudspeakers in said at least one line source subtend an angle greater than 0° and less than substantially 10°.

15. An array as claimed in claim 1, in which said propagation axes of an upper pair of said loudspeakers of said at least one line source subtend a smaller angle then said propagation axes of a lower pair of said loudspeakers.

16. An array as claimed in claim 1, in which said at least one line source is convex.

17. An array as claimed in claim 1, in which said loudspeakers of said at least one line source are disposed on an arc which is part of one of a circle, a catenary, a parabola and a hyperbola.

18. An array as claimed in claim 17, in which said loudspeakers of said at least one line source are arranged to radiate away from a centre of curvature of said arc.

19. An array as claimed in claim 1, in which said loudspeaker of said at least one line source are of a same type.

20. An array as claimed in claim 1, comprising a plurality of said line sources disposed laterally adjacent each other.

21. An array as claimed in claim 20, in which said common plane of an adjacent pair of said line sources subtend an angle substantially equal to half a sum of said dispersion pattern angles, in said planes perpendicular to said one dimensions, of first and second ones of said loudspeakers in first and second ones, respectively, of said adjacent pair of said line sources.

22. An array as claimed in claim 20, in which adjacent pairs of said loudspeakers in different ones of said line sources are physically time-aligned in a direction bisecting said propagation axes of said adjacent pair of said loudspeakers.

23. An array as claimed in claim 20, in which said loudspeakers of said line sources are of a same type.

24. A loudspeaker system comprising a plurality mid-range of loudspeaker arrays, each of which has a frequency range from substantially 250 Hz to substantially 8 KHZ and comprises at least one line source, said at least one line source comprising a curved one-dimensional array of loudspeakers, each of which comprises a cone diaphragm driver and has a dispersion pattern angle of less than 60° in a plane which is perpendicular to a one-dimension of said one-dimensional array at said loudspeaker, said loudspeakers having propagation axes in a common plane which, in use, is vertical, each adjacent pair of said loudspeakers of each said line source being physically time-aligned in a direction bisecting said propagation axes of said loudspeakers of said adjacent pair, said propagation axes of said loudspeakers of said adjacent pairs in at least part of each said line source subtending an angle greater than 0°, said propagation axes of said loudspeakers of each said adjacent pair in each said line source subtending an angle of less than or substantially equal to 10°.

* * * * *